US010811207B2

(12) United States Patent
Lim et al.

(10) Patent No.: US 10,811,207 B2
(45) Date of Patent: Oct. 20, 2020

(54) ARC EXTINGUISHING UNIT OF MOLDED CASE CIRCUIT BREAKER

(71) Applicant: LSIS CO., LTD., Anyang-si, Gyeonggi-do (KR)

(72) Inventors: Jeongjae Lim, Anyang-si (KR); Kihwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 16/511,707

(22) Filed: Jul. 15, 2019

(65) Prior Publication Data

US 2020/0027677 A1 Jan. 23, 2020

(30) Foreign Application Priority Data

Jul. 18, 2018 (KR) ..... 10-2018-0083684
Aug. 27, 2018 (KR) ..... 10-2018-0100547

(51) Int. Cl.
*H01H 71/02* (2006.01)
*H01H 71/24* (2006.01)

(52) U.S. Cl.
CPC .... *H01H 71/0207* (2013.01); *H01H 71/2472* (2013.01)

(58) Field of Classification Search
CPC ..... H01H 9/345; H01H 9/346; H01H 9/362; H01H 2009/367; H01H 2009/365;
(Continued)

(56) References Cited

U.S. PATENT DOCUMENTS 1,963,643 A * 6/1934 Brainard ..... H01H 9/36 218/149
2,244,061 A * 6/1941 Graves, Jr. ..... H01H 9/362 218/149

(Continued)

FOREIGN PATENT DOCUMENTS

CN 101540248 A 9/2009
EP 0269750 A1 6/1988

(Continued)

OTHER PUBLICATIONS

Translation JP55153741 (original doc. published Nov. 6, 1980) (Year: 1980).*

(Continued)

*Primary Examiner* — William A Bolton
(74) *Attorney, Agent, or Firm* — K&L Gates LLP

(57) ABSTRACT

The present disclosure relates to an arc extinguishing device of a molded case circuit breaker which includes a fixed contactor fixedly provided on part of a base assembly case; a movable contactor brought into contact with or separated from the fixed contactor; and an arc extinguishing unit configured to extinguish an arc generated when the movable contactor is separated from the fixed contactor, and the arc extinguishing unit including a pair of side plates provided on the base assembly case; and a plurality of grids provided to have a predetermined distance between the pair of side plates, and the grid including a first grid formed with a first cutout portion on a first side surface where an arc is generated; and a second grid formed with a second cutout portion having a depth different from that of the first cutout portion on a second side surface where an arc is generated.

13 Claims, 10 Drawing Sheets

(58) Field of Classification Search
CPC ..... H01H 33/08; H01H 71/9287; H01H 71/2472; H01H 73/18; H01H 73/00; H01H 33/10
USPC ..... 218/149, 156, 158, 139, 15, 34, 38, 46
See application file for complete search history.

(56) References Cited

U.S. PATENT DOCUMENTS

| | | | | | |
|---|---|---|---|---|---|
| 2,749,410 | A * | 6/1956 | Weston | H01H 9/34 | 218/149 |
| 4,612,426 | A * | 9/1986 | Maier | H01H 9/362 | 218/151 |
| 5,003,137 | A | 3/1991 | Tateishi et al. | | |
| 6,624,373 | B2 * | 9/2003 | Raabe | H01H 9/362 | 218/149 |

FOREIGN PATENT DOCUMENTS

| | | | | |
|---|---|---|---|---|
| JP | S51-130458 U | | 10/1976 | |
| JP | 55153741 | * | 11/1980 | H01H 33/10 |
| JP | S55-153741 U | | 11/1980 | |
| JP | S61-99349 U | | 6/1986 | |
| JP | S63-000915 A | | 1/1988 | |
| JP | S63-41845 U | | 3/1988 | |
| JP | S63-0167645 U | | 11/1988 | |
| JP | H03-043920 A | | 2/1991 | |
| JP | WO2013161903 | * | 11/2013 | H01H 73/18 |
| WO | WO 1987/07427 A1 | | 12/1987 | |
| WO | 2013171903 A1 | | 11/2013 | |

OTHER PUBLICATIONS

Translation WO2013171903 (Original doc. published Nov. 21, 2013) (Year: 2013).*

European Search Report for related European Application No. 19186593.0; action dated Dec. 19, 2019; (9 pages).

Japanese Office Action dated Jun. 12, 2020 issued in corresponding Japanese Patent Application No. 2019-131963—5 Pages.

* cited by examiner

ARC EXTINGUISHING UNIT OF MOLDED CASE CIRCUIT BREAKER

CROSS-REFERENCE TO RELATED APPLICATIONS

Pursuant to 35 U.S.C. § 119(a), this application claims the benefit of an earlier filing date of and the right of priority to Korean Application Nos. 10-2018-0083684 and 10-2018-0100547, filed on Jul. 18, 2018 and Aug. 27, 2018, respectively, the contents of which are incorporated by reference herein in its entirety.

BACKGROUND OF THE INVENTION

1. Field of the Invention

The present disclosure relates to a molded case circuit breaker, and more particularly, to an arc extinguishing device of a molded case circuit breaker.

2. Description of the Conventional Art

In general, a molded case circuit breaker (MCCB) is an electric device that automatically shuts off a circuit during an overload condition or a short-circuit accident to protect the circuit and load.

The molded case circuit breaker includes a terminal unit capable of being connected to a power source or a load, a contact unit including a fixed contactor and a movable contactor brought into contact with or separated from the fixed contactor to connect or disconnect a circuit, a switching mechanism that moves the movable contactor to provide power required for the switching of the circuit, a trip unit that senses an overcurrent or a short-circuit current flowing on the circuit to induce a trip operation of the switching mechanism, and an arc extinguishing unit for extinguishing an arc generated when an abnormal current is interrupted, and the like.

FIG. 1 illustrates an internal structural view of a molded case circuit breaker according to the related art. A molded case circuit breaker according to the related art includes a fixed contactor 1 and a movable contactor 2 constituting a contact unit provided to connect or disconnect a circuit transmitted from a power source side to a load side within a case 9 formed of an insulating material, a switching mechanism unit 4 that provides power capable of rotating the movable contactor 2, an arc extinguishing unit 3 provided to extinguish an arc generated when a fault current is interrupted, and a trip unit 5 that detects an abnormal current to trip the switching mechanism, and the like. Here, reference numeral 8 denotes a case of a base assembly.

When a fault current flows in the circuit, a trip operation is carried out to separate the movable contactor 2 from the fixed contactor 1 to disconnect the flow of the current, and an arc is generated between the contact portions 1, 2. At this time, the magnitude (intensity) of the arc is proportional to the magnitude of the current. An arc is a discharge in which gas in the air instantaneously reaches a plasma state by a voltage, and the arc center temperature reaches 8,000-12,000° C. and has an explosive expansion pressure. As a result, it has characteristics in that the contact portions 1, 2 are melted and consumed, and neighboring parts are deteriorated and destroyed, and thus the continuity or non-continuity of the arc greatly affects the performance and durability of the circuit breaker. Therefore, the arc must be quickly interrupted, extinguished and discharged from the arc extinguishing unit 3.

In this manner, in a molded case circuit breaker, an operation of processing an arc is a main purpose in interrupting a fault current to protect a product, a load and a line and directly affects the performance of the circuit breaker.

FIGS. 2 and 3 illustrate a base assembly in a molded case circuit breaker according to the related art. The base assembly includes a base assembly case 8 formed by injection molding with an insulating material, and contact portions 1, 2 and an arc extinguishing unit 3 provided on the base assembly case 8. FIG. 2 shows a conduction state, and FIG. 3 shows an interruption state.

The movable contactor 2 is coupled to a shaft 6 rotated by receiving a force of the switching mechanism unit 4 to rotate, and a contact unit at which a fixed contact of the fixed contactor 1 and a movable contact of the movable contactor 2 are brought into contact with each other is disposed inside a side plate of the arc extinguishing unit 3.

The operation of the base assembly when a fault current is interrupted is as follows.

When the fault current occurs, the switching mechanism unit 4 is actuated by the action of the trip unit 5, and accordingly, the shaft assembly 6 rotates in a clockwise direction. At this time, an arc is generated at the contact portions 1, 2, and the arc is dividedly cooled while moving to a grid 7 in an arc chamber 3. As the arc moves along the grid 7, an arc voltage increases and the arc eventually disappears.

At this time, it is obvious that the larger the number of the grids 7, the more advantageous to arc extinguishing.

However, since the size of the product is limited, a large number of grids 7 cannot be provided. Therefore, other measures are needed.

Furthermore, the inclination angle of the grids 7 is not directed toward an exhaust port 8*a* other than the grids at an upper portion, and therefore, most of arc gas escaping between the grids 7 tends not to be efficiently discharged to the exhaust portion 8*a* due to bouncing back against a side wall of the base assembly case 8, as illustrated in FIG. 3. In case where the base assembly case 8 is formed compactly, such a poor discharge phenomenon becomes serious, and dust is left in the base assembly case 8 or the pressure is increased.

SUMMARY OF THE INVENTION

The present disclosure has been made to solve the above-mentioned problems, and an aspect of the present disclosure is to provide an arc extinguishing device of a molded case circuit breaker having improved arc extinguishing performance.

Another aspect of the present disclosure is to provide an arc extinguishing device of a molded case circuit breaker having improved arc discharge performance.

An arc extinguishing device of a molded case circuit breaker according to an aspect of the present disclosure may include a fixed contactor fixedly provided on part of a base assembly case; a movable contactor brought into contact with or separated from the fixed contactor; and an arc extinguishing unit configured to extinguish an arc generated when the movable contactor is separated from the fixed contactor, and the arc extinguishing unit may include a pair of side plates provided on the base assembly case; and a plurality of grids provided to have a predetermined distance between the pair of side plates, and the grid may include a first grid formed with a first cutout portion on a first side surface where an arc is generated; and a second grid formed with a second cutout portion having a depth different from that of the first cutout portion on a second side surface where an arc is generated.

Here, a plurality of insertion holes may be formed in the side plate, and a plurality of insertion protrusions respectively fastened to the insertion holes may be formed on the grid.

Furthermore, the first grid and the second grid may be alternately provided on the side plate.

Furthermore, a depth (height) of the first cutout portion or the second cutout portion may be formed to be smaller (lower) than a position of the insertion protrusion.

Furthermore, a depth difference between the first cutout portion and the second cutout portion may be formed smaller than a cutout portion having a smaller depth between the first cutout portion and the second cutout portion.

Furthermore, the first grid or the second grid may be formed in a horizontally symmetrical manner.

In addition, a first central portion of the first cutout portion and a second central portion of the second cutout portion may be disposed on horizontal center lines of the first grid and the second grid, respectively.

An arc extinguishing device of a molded case circuit breaker according to another aspect of the present disclosure may include a fixed contactor fixedly provided on part of a base assembly case; a movable contactor brought into contact with or separated from the fixed contactor; and an arc extinguishing unit configured to extinguish an arc generated when the movable contactor is separated from the fixed contactor, and the arc extinguishing unit may include a pair of side plates provided on the base assembly case; and a plurality of grids provided to have a predetermined distance between the pair of side plates, and the grid may include a flat plate provided to have a predetermined first inclination angle with respect to a bottom surface of the base assembly case, and a rear plate extended from a rear surface of the flat plate to have a predetermined second inclination angle, wherein the second inclination angle is formed to be larger than the first inclination angle.

Here, leg portions may be protruded on both sides of a front end portion of the flat plate along a length direction.

Furthermore, the device may further include a side cap to which the leg portions are inserted and coupled.

Furthermore, a cutout surface may be formed on both sides of the rear plate.

Furthermore, the plurality of grids may be formed such that a rear plate of a grid located below is formed to be longer than that of a grid located above.

In addition, the plurality of grids may be formed such that an inclination angle of a rear plate of a grid located below is formed to be longer than that of a grid located above.

According to an arc extinguishing device of a molded case circuit breaker in accordance with an aspect of the present disclosure, a first grid and a second grid having different depths of cutout portions are alternately provided to improve arc extension capability Accordingly, arc extinguishing performance is improved.

According to an extinguishing device for a molded case circuit breaker in accordance with another aspect of the present disclosure, the grids are formed with rear plates inclined toward the exhaust port to improve arc gas discharge performance. Accordingly, arc extinguishing performance is improved.

Here, since the rear plates of the grids located below are formed to be longer than those located above, the movement direction of arc gas escaping the grids is easily changed to an upward direction.

Furthermore, since the inclination angle of the rear plates of the grids located below is formed to be larger than that of the rear plates of the grids located above, arc gas is concentrated toward the exhaust port.

As a result, a distance between each grid may be set smaller to provide a larger number of grids in the same space.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, preferred embodiments of the present disclosure will be described with reference to the accompanying drawings, which are intended to describe the present disclosure in detail to allow a person skilled in the art to easily carry out the invention, but not to mean that the technical concept and scope of the present disclosure are limited thereto.

An arc extinguishing device of a molded case circuit breaker according to each embodiment of the present disclosure will be described in detail with reference to the drawings.

Figure 1:
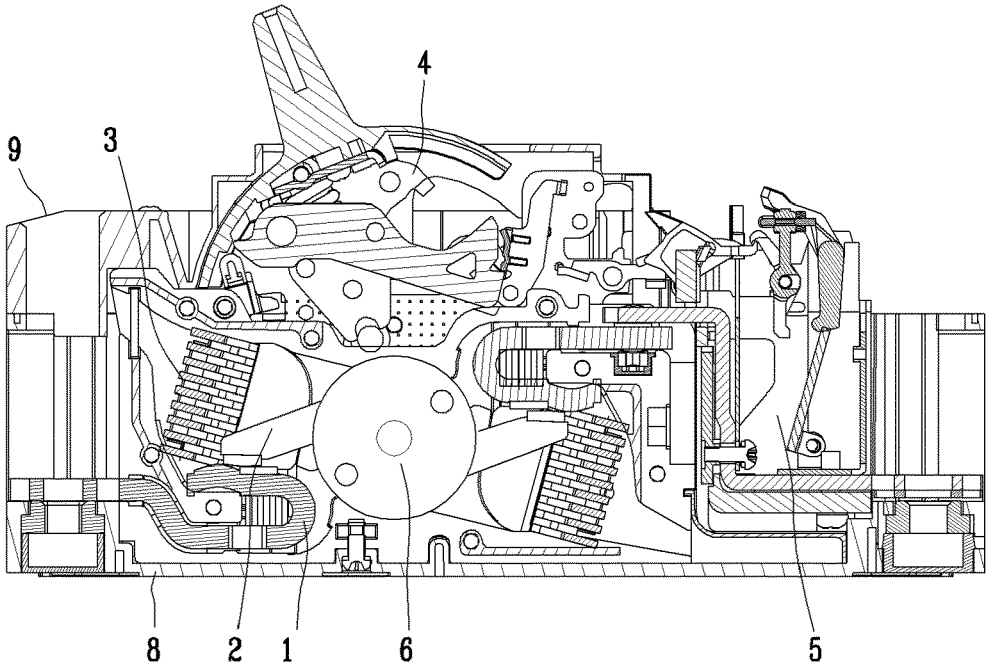
FIG. 1 PRIOR ART
FIG. 1 is an internal structural view illustrating a molded case circuit breaker according to the related art.
Figure 2:
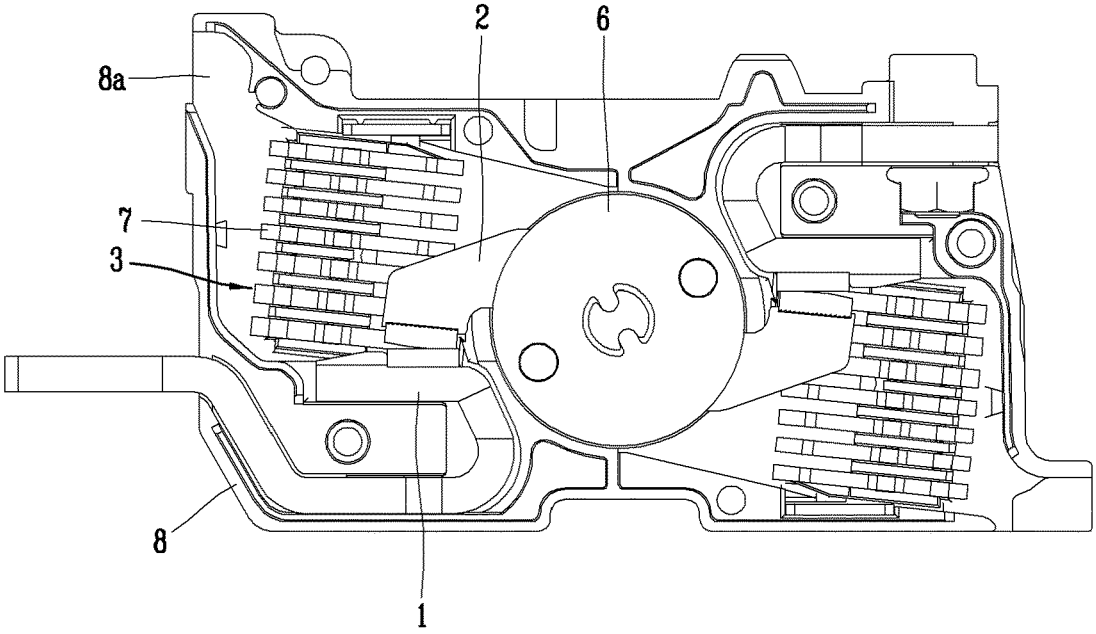
FIG. 2 PRIOR ART
FIGS. 2 and 3 are internal structural views of a base assembly in FIG. 1, which show a conduction state (closed state) and cut-off state (open state), respectively.
Figure 3:
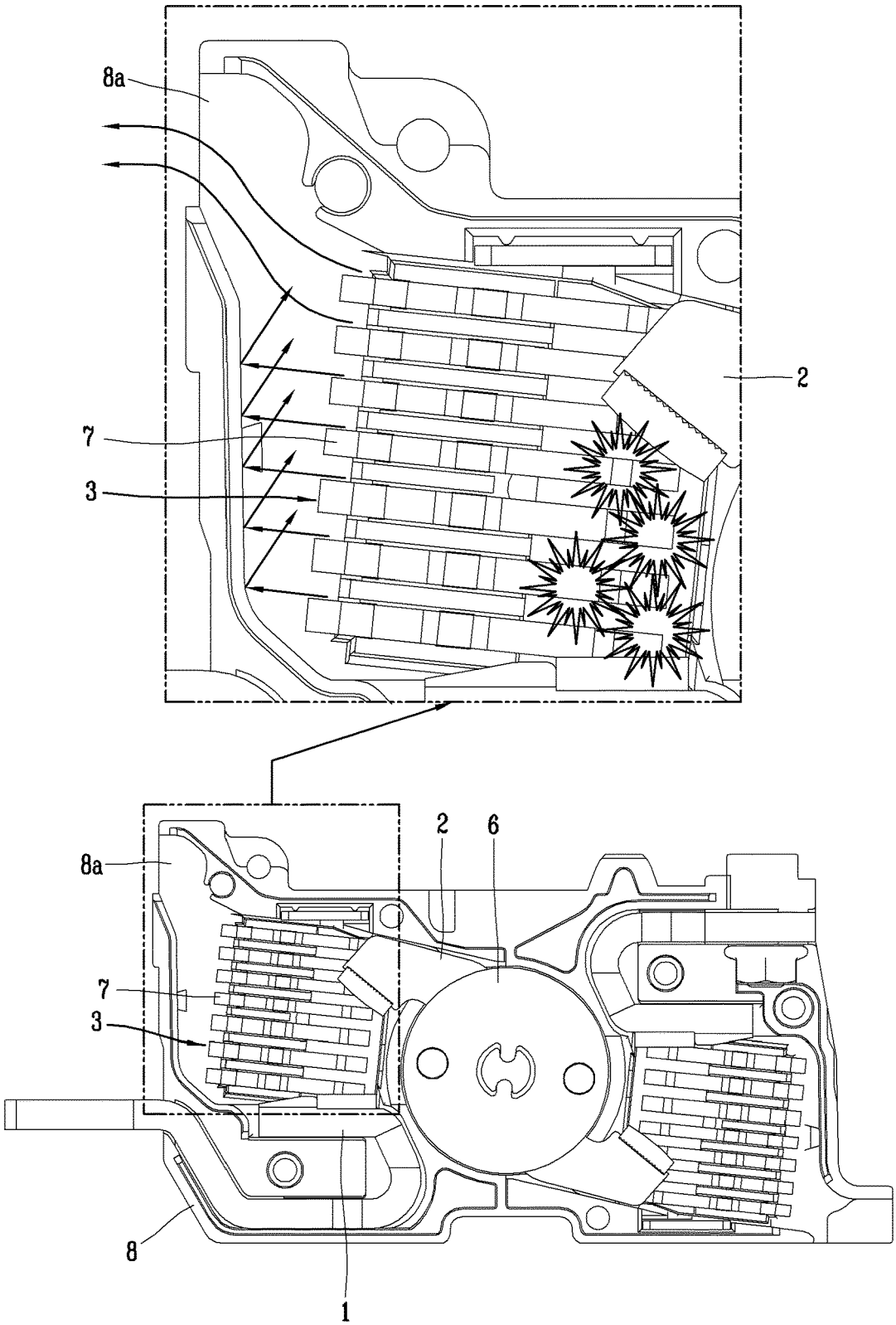
FIG. 3 PRIOR ART
Figure 4:
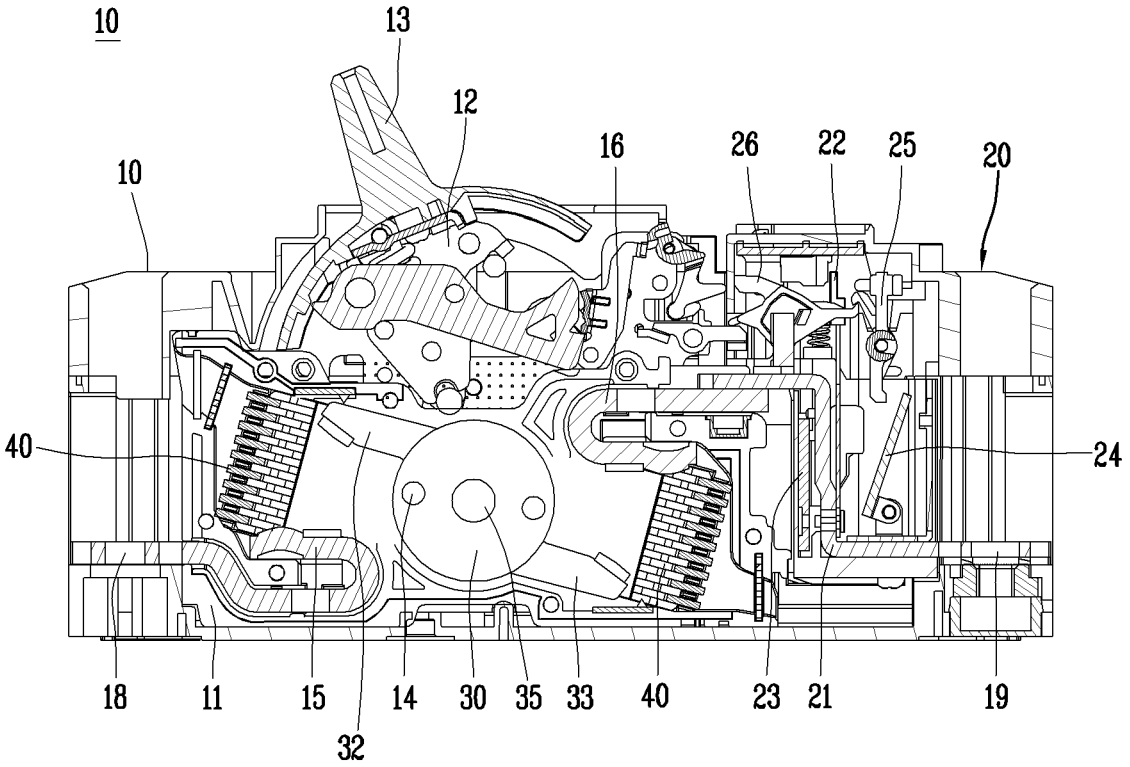
FIG. 4 is an internal structural view illustrating a molded case circuit breaker according to an aspect of the present disclosure.
Figure 5:
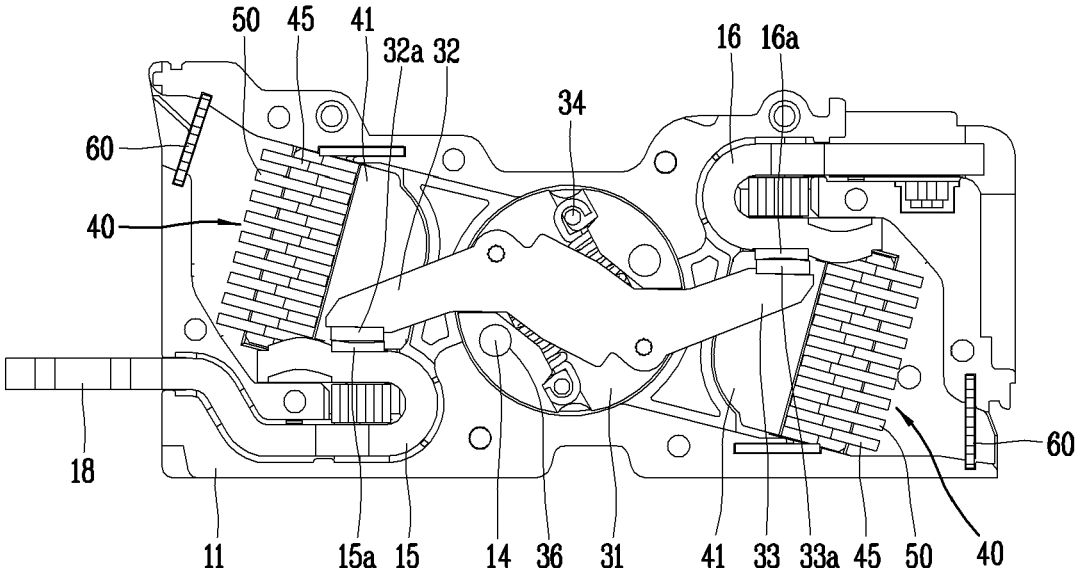
FIGS. 5 and 6 are internal structural views of a base assembly in FIG. 4, which show a conduction state (closed state) and cut-off state (open state), respectively.
Figure 6:
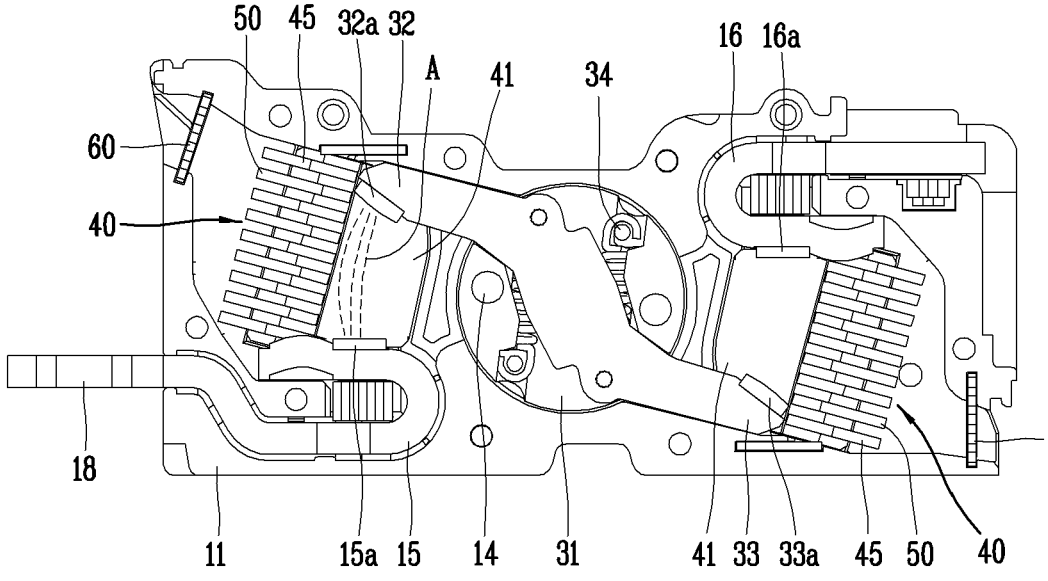
Figure 7:
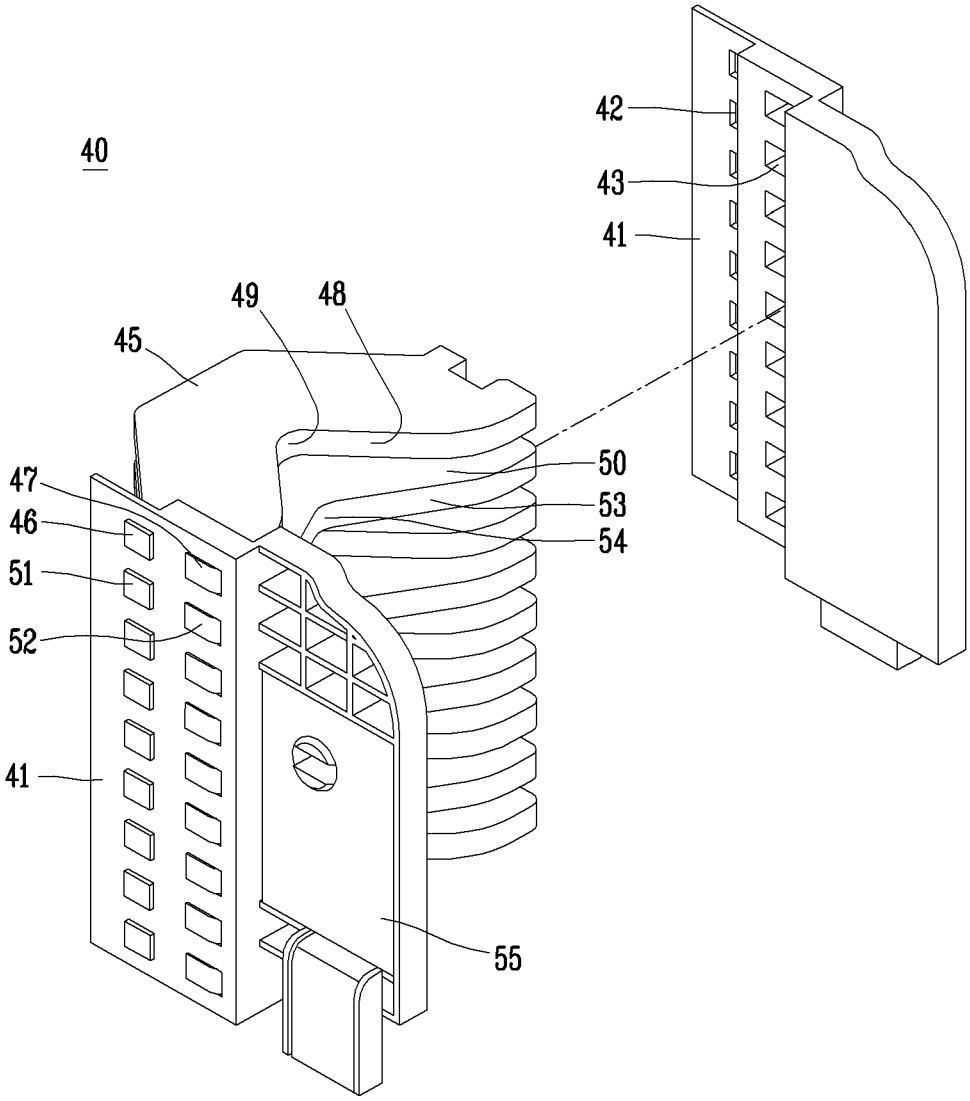
FIG. 7 is a perspective view showing an arc extinguishing unit in FIG. 5.

FIG. 4 is an internal structural view illustrating a molded case circuit breaker according to an aspect of the present disclosure, and FIGS. 5 and 6 are internal structural views of a base assembly in FIG. 4, which show a conduction state (closed state) and cut-off state (open state), respectively.

An arc extinguishing system for a molded case circuit breaker according to an embodiment of the present disclosure may include fixed contactors 15, 16 fixedly provided on part of a base assembly case 11; movable contactors 32, 33 brought into contact with or separated from the fixed contactors 15, 16; and an arc extinguishing unit 40 configured to extinguish an arc generated when the movable contacts 32, 33 are separated from the fixed contactors 15, 16, wherein the arc extinguishing unit 40 comprises a pair of side plates 41 provided on the base assembly case 11; and a plurality of grids 45, 50 provided at predetermined intervals between the pair of side plates 41, and the grids 45, 50 comprise a first grid 45 formed with a first cutout portion 48 on a side surface where an arc is generated, and a second grid 50 formed with a second cutout portion 53 having a depth different from that of the first cutout portion 48 on a side surface where an arc is generated.

A case 10 accommodates and supports the components of the molded case circuit breaker. The case 10 is formed in a substantially box shape. A handle 13 is exposed on an upper surface of the case 10. The handle 13 operates a switching mechanism 12 by a user's manual operation force.

Terminal portions 18, 19 capable of being connected to a power source or a load are provided on front and rear surfaces of the case 10. The terminal portions 18, 19 are provided for each phase (or for each pole). For example, in the case of a three-phase four-pole molded case circuit breaker, four terminal portions may be provided on the power source side and the load side, respectively.

Fixed contactors 15, 16 are fixedly provided inside the case 10. The fixed contactors 15, 16 are connected to the terminal portions 18, 19, respectively. In the case of a double molded case circuit breaker, the fixed contactors 15, 16 are provided on a power source side and a load side thereof, respectively. In other words, a power source side fixed contactor 15 and a load side fixed contactor 16 are provided. At this time, the power source side fixed contactor 15 may be directly connected to or integrally formed with the power source side terminal portion 18. The load side fixed contactor 16 may be connected to the load side terminal portion 19 through a trip mechanism 20 (particularly, a heater 21).

In the vicinity of the contact unit (fixed contactor and movable contactor), an arc extinguishing unit (arc extinguishing device) 40 is provided to extinguish an arc generated during interruption. In the case of a double molded case circuit breaker (double circuit breaker), the arc extinguishing units 40 are provided on a power source side and a load side thereof, respectively. The arc extinguishing unit 40 includes a pair of side plates 41 and a plurality of grids 45, 50 coupled to the side plates 41 at predetermined intervals.

A trip unit 20 that detects an abnormal current flowing through a circuit and tripping the switching mechanism is provided in a part of the case 10. The trip portion 20 is usually provided on the load side. The trip unit 20 may include a heater 21 connected to the load side terminal unit 19, a bimetal 22 coupled to the heater 21 to sense heat so as to be bent according to the amount of heat, a magnet 23 and an amateur 24 provided around the heater 21, a crossbar 25 provided to rotate by the contact of the bimetal 22 and the armature 24, and a shooter 26 restrained or released by the rotation of the crossbar 25 to restrain or release a nail (not shown) of the switching mechanism 12. Typically, the bimetal 22 is bent by heat generated from the heater 21 to rotate the crossbar 25 so as to operate the switching mechanism 12 during small current delay interruption, and the crossbar 25 rotates while the armature 24 is sucked by a magnetic force excited in the magnet 23 to operate the switching mechanism 12 during a large current during large current instant interruption.

The user's operation force is transferred to the switching mechanism 12 through the handle 13. A pair of rotation pins 14 are provided on the switching mechanism 12 to transfer the power of the switching mechanism 12 to each phase. The rotation pin 14 is formed to have a length across all phases and provided in the shaft assembly (or mover assembly) 30.

A base assembly case (briefly, base) 11 is provided. The base assembly case 11 may be formed by injection molding. The base assembly case 11 is formed approximately in the form of a box. The base assembly case 11 is provided with contact portions 15, 16, 32, 33 and an arc extinguishing unit 40. The switching mechanism 12 may be provided at an upper portion of the base assembly case 11.

The shaft assembly 30 is provided. The shaft assembly 30 is provided with a rotation pin 14 passing therethrough. The shaft assembly 30 receives the switching power of the switching mechanism 12 by the rotation pin 14 to rotate. As the shaft assembly 30 rotates, the movable contactor 32, 33 also rotates to be brought into contact with or separated from the fixed contactors 15, 16.

The shaft assembly 30 includes a shaft body 31 and movable contactors 32, 33.

The shaft body 31 is formed in a cylindrical shape. A shaft 35 is protruded on both flat side surfaces (disk surfaces) of the shaft body 31. A pair of pinholes 36 through which the rotation pin 14 can be inserted are formed in the shaft body 31 in parallel to a direction of the shaft 35.

The movable contactors 32, 33 are rotatably provided on the shaft body 31. The movable contactor 32, 33 is brought into contact with or separated from the fixed contactors 15, 16 while rotating with the shaft body 31 or independently in a counterclockwise or clockwise direction to conduct or cut off the line.

Movable contacts 32*a*, 33*a* that can be brought into contact with the fixed contacts 15*a*, 16*a* of the fixed contactors 15, 16, respectively, are provided at both end portions of the movable contactors 32,33. The movable contacts 32*a*, 33*a* may be made of a conductive and durable material such as a chrome-copper (Cr—Cu) alloy.

The movable contactor 32,33 rotates together with the shaft body 31 in the case of a general small current or large current interruption situation, but the movable contactor 32,33 rotates independently by a sudden electromagnetic repulsion force during cold current interruption. In this case, the movable contactor 32, 33 comes into contact with the shaft pin 34 of the shaft assembly 30 to stop the rotation.

FIGS. 7 through 10 will be further described. The arc extinguishing unit 40 is provided around the fixed contacts 15*a*, 16*a* of the fixed contactors 15, 16 and the movable contacts 32*a*, 33*a* of the movable contactors 32 and 33.

The arc extinguishing unit (arc chamber, arc shooter) 40 includes a side plate 41 that forms a pair of side walls facing symmetrically and a first grid 45 formed with a plurality of steel sheets to be inserted in parallel into the side plate 41 at predetermined intervals. The arc extinguishing unit is surrounded by the side plate 41 and the first grid 45 to form an internal space capable of extinguishing an arc.

When the circuit is in a normal state, the fixed contacts 15*a*, 16*a* of the fixed contactors 15, 16 are connected to the movable contacts 32*a*, 33*a* of the movable contactors 32, 33 to allow current to flow. When an accident current occurs in the circuit, the movable contactors 32, 33 are rotated by the mechanism unit (not shown) to separate the movable contacts 32*a*, 33*a* from the fixed contacts 15*a*, 16*a* so as to cut off the current. At this time, an arc is generated between the movable contacts 32*a*, 33*a* and the fixed contacts 15*a*, 16*a*. The arc is divided into short arcs while entering between the first grids 45 to increase an arc voltage. In addition, the arc voltage is further increased by an arc extinguishing gas, such as SF6, existing in the arc extinguishing unit. As a result, the arc is annihilated while suppressing the emission of free electrons.

A pair of symmetrical side plates 41 are provided. The side plates 41 are preferably made of an insulating material. In other words, an arc generated at the time of interruption may be reflected by the side plates 41 and collected by the grids 45, 50.

A plurality of insertion holes 42, 43 to which the grids 45, 50 can be coupled are formed in the side plate 41. A first insertion hole 42 and a second insertion hole 43 may be formed to have different sizes from each other.

A magnet 55 may be provided on a rear surface of the side plate 41. The magnet 55 is provided at a portion where the contact portions 15, 16, 32, 33 are positioned to generate a magnetic force that induces an arc generated at the time of contact in a direction in which the grids 45, 50 are present.

The grids 45, 50 are provided to attract and extinguish the arc. At this time, a plurality of grids 45, 50 are provided on the pair of side plates 41.

The grids 45, 50 are composed of a first grid 45 and a second grid 50.

The first grid 45 is formed as a flat plate. The first grid 45 is preferably made of steel so as to attract the arc. A plurality of insertion protrusions 46, 47 are protruded from both side surfaces of the first grid 45 to be provided on the side plate 41. The insertion protrusions 46, 47 of the first grid 45 are inserted into and coupled to the insertion holes 42, 43 of the side plate 41. At this time, a caulking operation may be carried out for stable coupling.

On the first grid 45, a central portion of the front portion (a side surface where an arc is generated, a side surface adjacent to the contact portion, a first side surface) is cut out to form a first cutout portion 48. The first cutout portion 48 is formed to provide a space in which the contact portion can be operated to attract and divide the arc. The first cutout portion 48 may be formed by a V-shaped groove, a U-shaped groove, or the like. As the first cutout portion 48 is provided, it may be possible to improve arc extinguishing performance due to the attraction and division of the arc. The deepest portion of the first cutout portion 48 will be referred to as a first central portion 49. The first grid 45 may be formed in a horizontally symmetrical manner, and thus the first central portion 49 is horizontally located on a center line.

Figure 10:
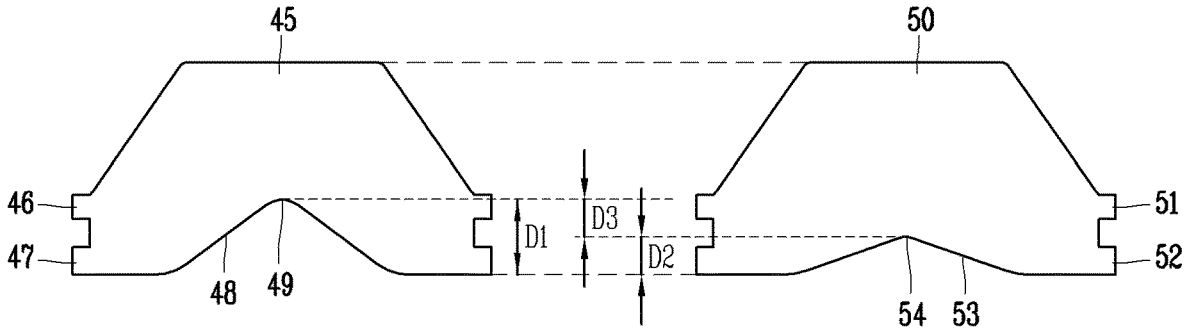
FIG. 10 is a plan view illustrating a first grid and a second grid in FIG. 7.

The first cutout portion 48 is not formed deeper than the position of the first insertion protrusion 46. In other words, as shown in FIG. 10, the height of the first central portion 49 is lower than that of an upper end portion of the first insertion protrusion 46 on a plan view in which the first side surface is placed downward. The strength of the first grid 45 may be weakened when the first grid 45 is formed too deeply, thereby preventing the first central portion 49 from being torn or bent.

The second grid 50 is formed as a flat plate. The second grid 50 is preferably made of steel so as to attract the arc. A plurality of insertion protrusions 51, 52 are protruded from both side surfaces of the second grid 50 to be provided on the side plate 41. The insertion protrusions 51, 52 of the second grid 50 are inserted into and coupled to the insertion holes 42, 43 of the side plate 41. At this time, a caulking operation may be carried out for stable coupling.

On the second grid 50, a central portion of the front portion (a side surface where an arc is generated, a side surface adjacent to the contact portion, a second side surface) is cut out to form a second cutout portion 53. The second cutout portion 53 is formed to provide a space in which the contact portion can be operated to attract and divide the arc. The second cutout portion 53 may be formed by a V-shaped groove, a U-shaped groove, or the like. As the second cutout portion 53 is provided, it may be possible to improve arc extinguishing performance due to the attraction and division of the arc. The deepest portion of the second cutout portion 53 will be referred to as a second central portion 54. The second grid 50 may be formed in a horizontally symmetrical manner, and thus the second central portion 54 is horizontally located on a center line.

The second cutout portion 53 is not formed deeper than the position of the second insertion protrusion 46. In other words, as shown in FIG. 10, the height of the second central portion 54 is lower than that of an upper end portion of the second insertion protrusion 51 on a plan view in which the first side surface is placed downward. The strength of the second grid 50 may be weakened when the second grid 50 is formed too deeply, thereby preventing the second central portion 54 from being torn or bent.

The second cutout portion 53 is formed to have a smaller depth than the first cutout portion 48. Here, if the depth (height) of the first central portion 49 is D1 and the depth (height) of the second central portion 54 is D2, then D1>D2. At this time, the depth (D1) of the first central portion 49 does not exceed the depth (D2) of the second central portion 54 by a factor of two. In other words, a depth difference (D3) between the first central portion 49 and the second central portion 54 is set to be smaller than ½ of the depth (D1) of the first central portion 49. This is to prevent the depth of the second central portion 54 from being set too low. The arc extinguishing capability of the second grid 50 may be reduced when the depth (D2) of the second central portion 54 is set too small.

A plurality of first grids 45 and second grids 50 may be provided respectively, and provided in multiple layers at predetermined intervals on the side plate 41. Here, it is preferable that the first grid 45 and the second grid 50 are provided alternately with each other. In other words, it is preferably provided in the order of the first grid 45, the second grid 50, the first grid 45, the second grid 50, . . . from the top. Accordingly, the arc is additionally extended from the second central portion 54 to the first central portion 49. As a result, arc extension and arc extinguishing performance are improved.

A passage through which an arc can pass is provided between the first grid 45 and the second grid 50. An interval when the first grid 45 and the second grid 50 are provided in a stacked manner may be appropriately set in consideration of the division and attraction force of the arc. Since the arc extension capability of the arc chamber in the present embodiment is improved, and thus it may be possible to arrange the grid intervals of the arc chamber to be relatively narrower than those of the related art. As a result, a larger number of grids 45, 50 may be provided.

An exhaust plate 60 is provided. The exhaust plate 60 is provided behind the grids 45, 50 to discharge arc gas and prevent foreign substances from intruding. A plurality of ventilation holes are formed in the exhaust plate 60.

According to an arc extinguishing device of a molded case circuit breaker in accordance with an aspect of the present disclosure, a first grid and a second grid having different depths of cutout portions are alternately provided to improve arc extension capability Accordingly, arc extinguishing performance is improved.

Figure 11:
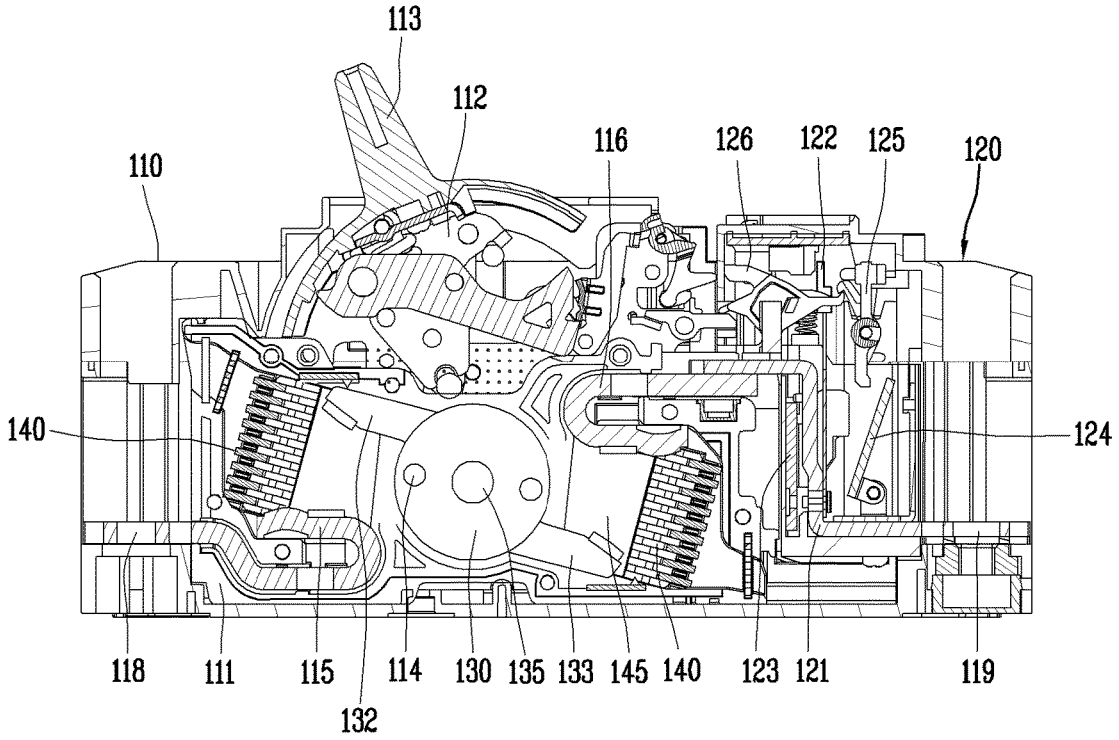
FIG. 11 is an internal structural view illustrating a molded case circuit breaker according to another aspect of the present disclosure.
Figure 12:
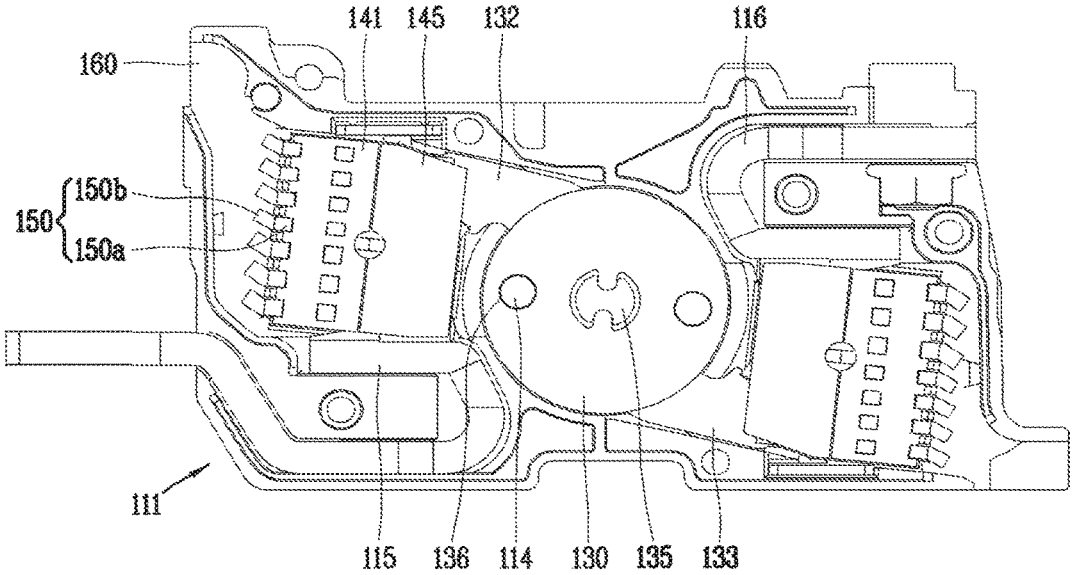
FIG. 12 is a front view illustrating a base assembly in FIG. 11.
Figure 13:
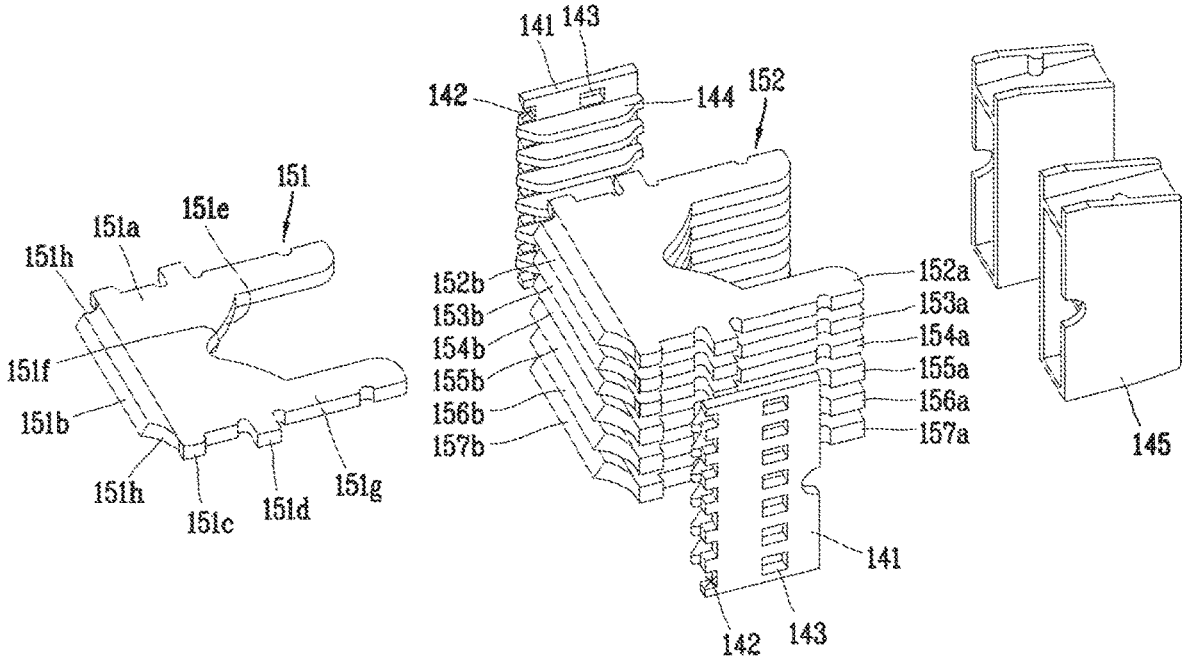
FIG. 13 is an exploded perspective view illustrating an arc extinguishing unit in FIG. 12.
Figure 14:
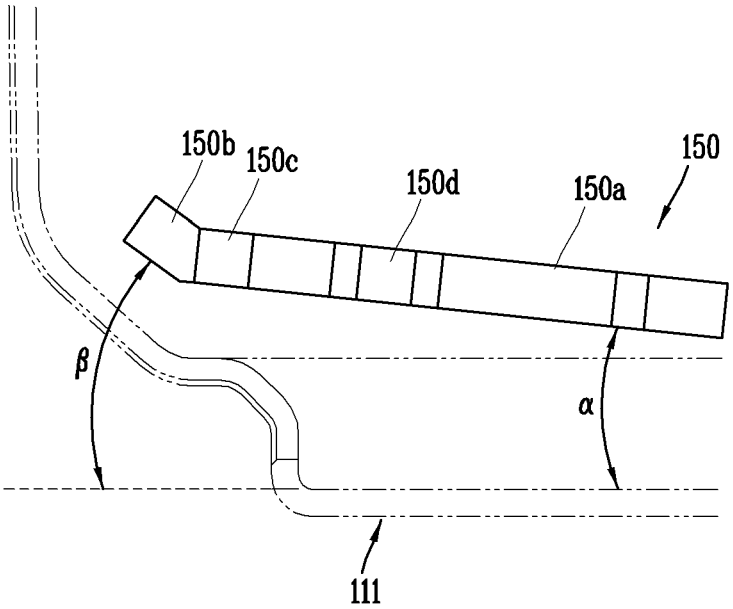
FIG. 14 is a partial detail view of FIG. 12.

FIG. 11 is an internal structural view illustrating a molded case circuit breaker according to another aspect of the present disclosure, and FIG. 12 is a front view illustrating a base assembly, and FIG. 13 is an exploded perspective view illustrating an arc extinguishing unit, and FIG. 14 is a partial detail view of FIG. 11.

An arc extinguishing system for a molded case circuit breaker according to another aspect of the present disclosure may include fixed contactors 115, 116 fixedly provided on part of a base assembly case 111; movable contactors 132, 133 brought into contact with or separated from the fixed contactors 115, 116; and an arc extinguishing unit 140 configured to extinguish an arc generated when the movable contacts 132, 133 are separated from the fixed contactors 115, 116, wherein the arc extinguishing unit 140 includes a pair of side plates 141 provided on the base assembly case 111; and a plurality of grids 150 provided to have a predetermined distance between the pair of side plates 141, and the grids 150 include a flat plate 150*a* formed to have a predetermined first inclination angle with respect to a bottom surface of the base assembly case 111 and a rear plate 150*b* extended from a rear surface of the flat plate 150*a* to have a predetermined second inclination angle, and herein, the second inclination angle is formed to be larger than the first inclination angle.

A case 110 accommodates and supports the components of the molded case circuit breaker. The case 110 is formed in a substantially box shape. A handle 113 is exposed on an upper surface of the case 110. The handle 113 operates a switching mechanism 112 by a user's manual operation force.

Terminal portions 118, 119 capable of being connected to a power source or a load are provided on front and rear surfaces of the case 110. The terminal portions 118, 119 are provided for each phase (or for each pole). For example, in the case of a three-phase four-pole molded case circuit breaker, four terminal portions may be provided on the power source side and the load side, respectively.

Fixed contactors 115, 116 are fixedly provided inside the case 110. The fixed contactors 115, 116 are connected to the terminal portions 118, 119, respectively. In the case of a double molded case circuit breaker, the fixed contactors 115, 116 are provided on a power source side and a load side thereof, respectively. In other words, a power source side fixed contactor 115 and a load side fixed contactor 116 are provided. At this time, the power source side fixed contactor 115 may be directly connected to or integrally formed with the power source side terminal portion 118. The load side fixed contactor 116 may be connected to the load side terminal portion 119 through a trip mechanism (particularly, a heater 121).

In the vicinity of the contact unit (fixed contactor and movable contactor), an arc extinguishing unit (arc extinguishing device) 140 is provided to extinguish an arc generated during interruption. In the case of a double molded case circuit breaker (double circuit breaker), the arc extinguishing units 140 are provided on a power source side and a load side thereof, respectively. The arc extinguishing unit 140 includes a pair of side plates 141 and a plurality of grids 150 coupled to the side plates 141 at predetermined intervals.

A trip unit 120 that detects an abnormal current flowing through a circuit and tripping the switching mechanism is provided in a part of the case 110. The trip portion 120 is usually provided on the load side. The trip unit 120 may include a heater 121 connected to the load side terminal unit 119, a bimetal 122 coupled to the heater 121 to sense heat so as to be bent according to the amount of heat, a magnet and an amateur 124 provided around the heater 121, a crossbar 125 provided to rotate by the contact of the bimetal 122 and the armature 123, and a shooter 126 restrained or released by the rotation of the crossbar 125 to restrain or release a nail (not shown) of the switching mechanism 112. Typically, the bimetal 122 is bent by heat generated from the heater 121 to rotate the crossbar 125 so as to operate the switching mechanism 112 during small current delay interruption, and the crossbar 125 rotates while the armature 124 is sucked by a magnetic force excited in the magnet 123 to operate the switching mechanism 112 during a large current during large current instant interruption.

The user's operation force is transferred to the switching mechanism 112 through the handle 113. A pair of rotation pins 114 are provided on the switching mechanism 112 to transfer the power of the switching mechanism 112 to each phase. The rotation pin 114 is formed to have a length across all phases and provided in the shaft assembly (or mover assembly) 130.

A base assembly case (briefly, base) 111 is provided. The base assembly case 111 may be formed by injection molding. The base assembly case 111 is formed approximately in the form of a box. The base assembly case 111 is provided with contact portions 115, 116, 132, 133 and an arc extinguishing unit 140. The switching mechanism 112 may be provided at an upper portion of the base assembly case 111.

In the base assembly case 111, an exhaust port 160 is formed at a rear portion of the arc extinguishing unit 140. The exhaust port 160 may be provided at an upper end portion of the power sidewall and at a lower end portion of the load sidewall, respectively.

The shaft assembly 130 is provided. The shaft assembly 130 is provided with a rotation pin 114 passing therethrough. The shaft assembly 130 receives the switching power of the switching mechanism 112 by the rotation pin 114 to rotate. As the shaft assembly 130 rotates, the movable contactor 132, 133 also rotates to be brought into contact with or separated from the fixed contactors 115, 116.

The shaft assembly 130 includes a shaft body 131 and movable contacts 132, 133.

Figure 15:
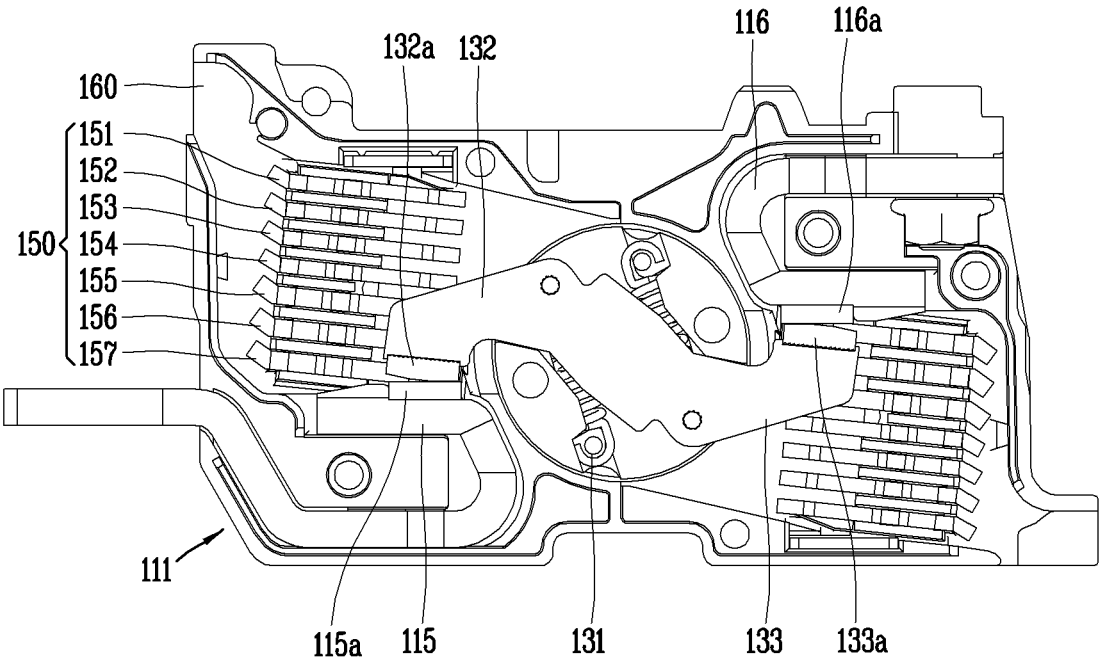
FIGS. 15 and 16 are functional views illustrating the base assembly of FIG. 12, which show a conduction state (closed state) and cut-off state (open state), respectively.
Figure 16:
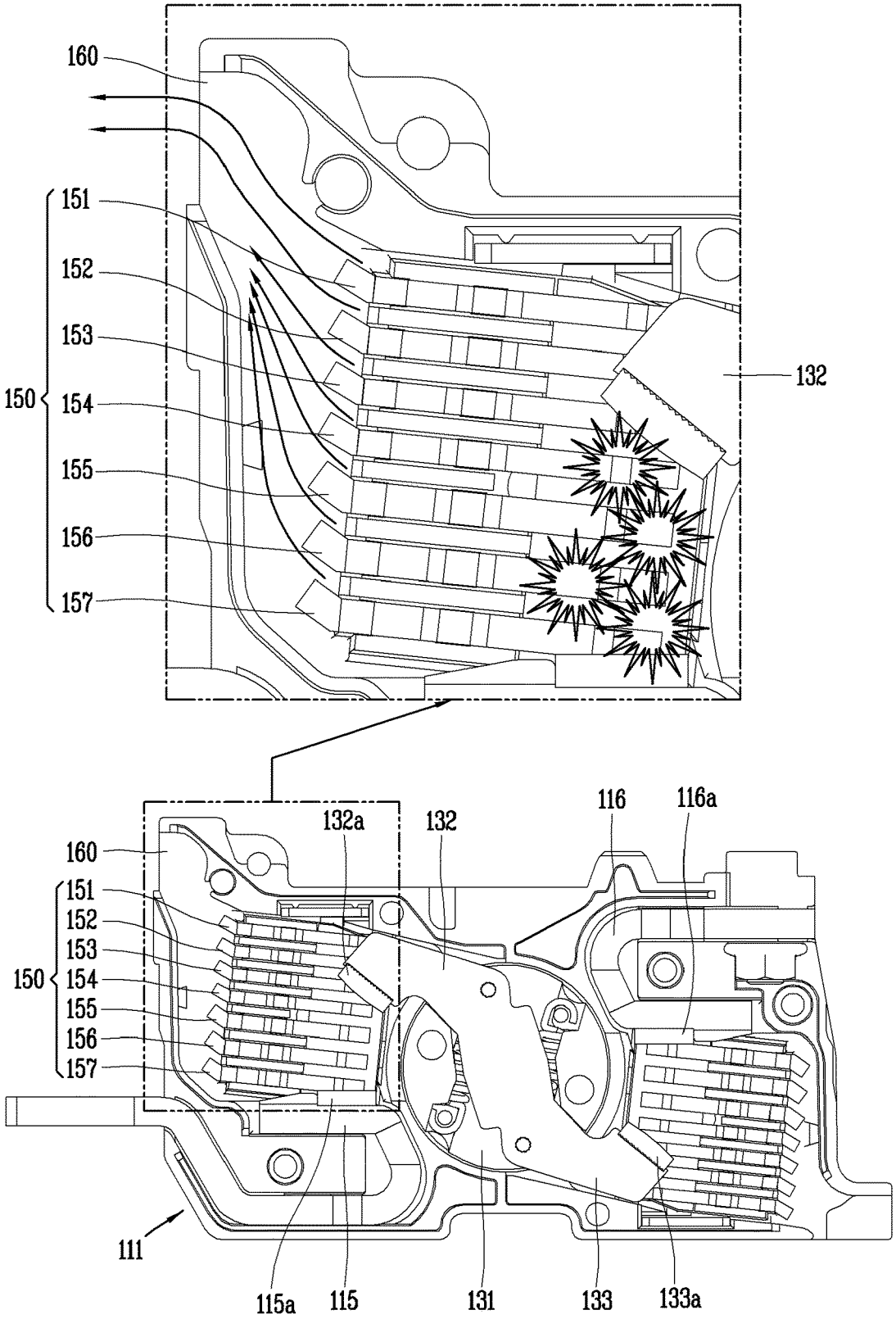

FIG. 15 will be further described. The movable contactors 132, 133 are rotatably provided on the shaft body 131. The movable contactor 132, 133 is brought into contact with or separated from the fixed contactors 115, 116 while rotating with the shaft body 131 or independently in a counterclockwise or clockwise direction to conduct or cut off the line.

Movable contacts 132*a*, 133*a* that can be brought into contact with the fixed contacts 115*a*, 116*a* of the fixed contactors 115, 116, respectively, are provided at both end portions of the movable contactors 132, 133. The movable contacts 132*a*, 133*a* may be made of a conductive and durable material such as a chrome-copper (Cr—Cu) alloy.

The movable contactor 132,33 rotates together with the shaft body 131 in the case of a general small current or large current interruption situation, but the movable contactor 132,33 rotates independently by a sudden electromagnetic repulsion force during cold current interruption. In this case, the movable contactor 132, 133 comes into contact with the shaft pin 134 of the shaft body to stop the rotation.

The arc extinguishing unit (arc chamber, arc shooter) 140 is provided around the fixed contacts 115*a*, 116*a* of the fixed contactors 115, 116 and the movable contacts 132*a*, 133*a* of the movable contactors 132, 133.

The arc extinguishing unit 140 includes a pair of side plates 141 forming side walls facing symmetrically and a plurality of grids 150 formed with a steel plate to be inserted in parallel into the side plates 141 at predetermined intervals. According to embodiments, the arc extinguishing unit 140 may include a side cap 145 inserted into a leg of the grid 150. The arc extinguishing unit is surrounded by the side plate 141, the grid 150 and the side cap 145 to form an internal space capable of extinguishing an arc.

Figure 8:
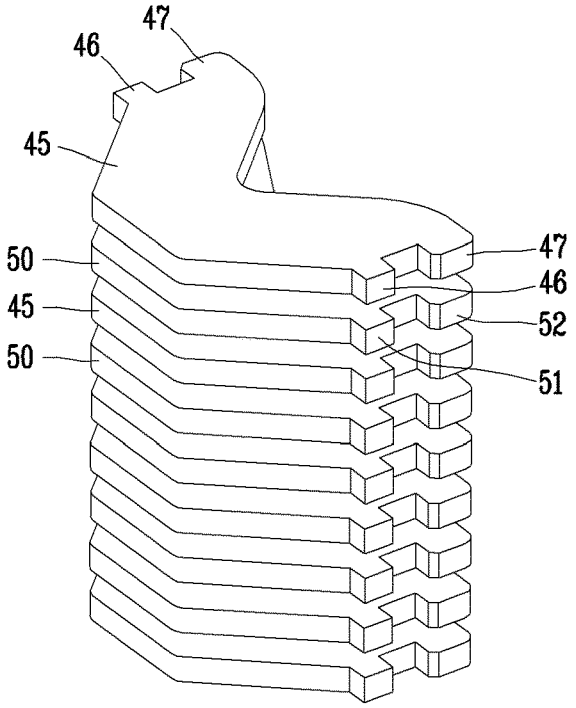
FIGS. 8 and 9 are perspective views illustrating grids in FIG. 7.
Figure 9:
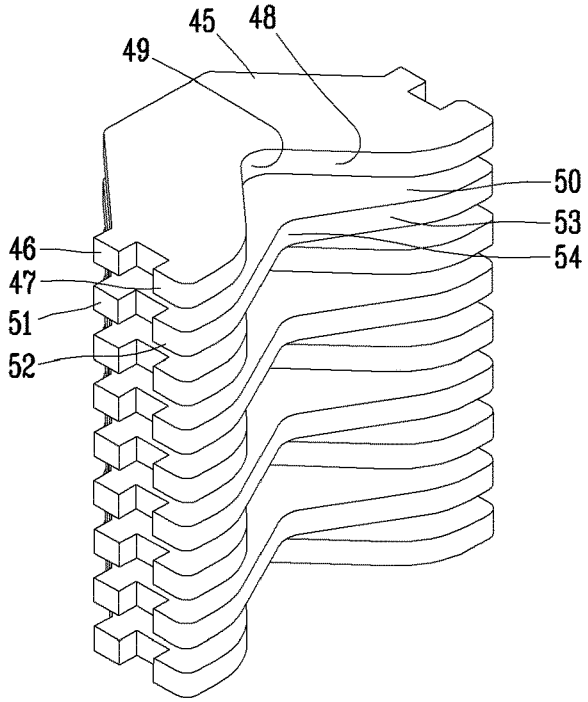

When the circuit is in a normal state, the fixed contacts 115*a*, 116*a* of the fixed contactors 115, 116 are connected to the movable contacts 132*a*, 133*a* of the movable contactors 132, 133 to allow current to flow as illustrated in FIG. 8. When an accident current occurs in the circuit, the shaft assembly 130 is rotated by the switching mechanism unit 112 or the movable contactors 132, 133 independently rotate to the movable contacts 132*a*, 133*a* from the fixed contacts 115*a*, 116*a* to cut off the current (see FIG. 9). At this time, an arc is generated between the movable contacts 132*a*, 33*a* and the fixed contacts 115*a*, 16*a*. The arc is divided into short arcs while entering between the grids 150 to increase an arc voltage. In addition, the arc voltage is further increased by an arc extinguishing gas, such as SF6, existing in the arc extinguishing unit. As a result, the arc is annihilated while suppressing the emission of free electrons.

A pair of symmetrical side plates 141 are provided. The side plates 141 are preferably made of an insulating material. In other words, an arc generated at the time of interruption may be reflected by the side plates 141 and collected between the grids 150.

A plurality of insertion grooves 142 and insertion holes 143 to which the grids 150 can be coupled are formed in the side plate 141. The insertion grooves 142 and the insertion holes 143 may be respectively formed in parallel at predetermined intervals in a vertical direction.

A protruding plate 144 inserted between each of the grids 150 may be provided on an inner surface of the side plate 141. The protruding plate 144 is preferably formed between each of the insertion grooves 142 and the insertion holes 143.

The grids 150 are provided to attract and extinguish the arc. At this time, a plurality of grids 150 are provided between the pair of side plates 141. The grid 150 is formed as a flat plate. The grid 150 is preferably made of steel so as to attract the arc.

The grid 150 includes a flat plate 150*a* and a rear plate 150*b* extended to have a predetermined angle with respect to the flat plate 150*a* on a rear surface portion of the flat plate 150*a*. Here, the flat plate 150*a* is provided so as to have a predetermined first inclination angle (α) with respect to a bottom surface of the base assembly case 111. On the other hand, the rear plate 150*b* is formed to have a predetermined second inclination angle (β) with respect to a bottom surface of the base assembly case 111.

Here, the first inclination angle (α) Is formed at a small acute angle (for instance, less than 15 degrees). Accordingly, a relatively large number of grids 150 may be arranged in a restricted internal space of the base assembly case 111.

On the other hand, the second inclination angle (β) is formed at an acute angle (for instance, within a range of 15-60 degrees) larger than the first inclination angle (α). Accordingly, arc gas sucked between the grids 150 is changed in the direction of movement from the rear plate 150*b* of the grid 150 toward the exhaust port 160.

In order to distinguish each grid, the each grid will be respectively referred to as a first grid 151, a second grid 152, a third grid 153, . . . from a grid provided at the top of a plurality of grids.

In order to describe the grids in more detail, the first grid 151 at the top will be described as an example. The first grid 151 at the top is composed of a first flat plate 151*a* and a first rear plate 151*b* (see FIG. 6).

A plurality of insertion protrusions 151*c*, 151*d* spaced apart from each other are protruded from both side surfaces of the first grid 45 to be provided on the side plate 141. The insertion protrusions 151*c*, 151*d* of the first grid 151 are inserted into and coupled to the insertion groove 142 and the insertion hole 143 of the side plate 141. At this time, a caulking operation may be carried out for stable coupling.

On the first grid 151, a central portion of the front portion (a side surface where an arc is generated, a side surface adjacent to the contact portion, a first side surface) is cut out to form a first cutout portion 151*e*. The first cutout portion 151*e* is formed to provide a space in which the contact portions 115, 116, 132, 133 can be operated to attract and divide the arc. The first cutout portion 151*e* may be formed by a V-shaped groove, a U-shaped groove, or the like. As the first cutout portion 151*e* is provided, it may be possible to improve arc extinguishing performance due to the attraction and division of the arc. The deepest portion of the first cutout portion 151*e* will be referred to as a first central portion 151*f*. The first grid 150 may be formed in a horizontally symmetrical manner, and thus the first central portion 151*f* is horizontally located on a center line.

The first central portion 151*f* of the first cutout portion 151*e* is preferably positioned between the first insertion protrusion 151*c* and the second insertion protrusion 151*d* with respect to a length direction. The strength of the grid 150 may be weakened when the first cutout portion 151*e* is formed to deeply on the grid 150, thereby preventing the first central portion 149 from being torn or bent.

On both sides of a front end portion of the first flat plate 151*a*, leg portions 151*g* are protruded in a length direction. The leg portion 151*g* is inserted and coupled to the side cap 145. Since the leg portion 151*g* is fixed to the side cap 145, the first grid 151 maintains the state of being stably coupled to the side plate 141.

The first rear plate 150*b* is extended from a rear surface of the first flat plate 151*a* to have a predetermined angle of inclination. Since the first rear plate 150*b* is formed in a state of being bent from the first flat plate 151*a*, the direction of arc gas that has passed through the first flat plate 151*a* is changed along the first rear plate 150*b*.

The first rear plate 150*b* has cutout surfaces 151*h* formed on both sides thereof. The cutout surface 151*h* facilitates the process of bending the first rear plate 150*b* from the first flat plate 151*a*. Furthermore, the cutout surface 151*h* also facilitate the operation of inserting the insertion protrusion 151*c* into the insertion groove 142.

Here, the description of the first grid 151 will be all applied to the other grids 152, 153, 154, . . . . In other words, each grid is formed in a similar shape.

Here, a rear plate of each grid may be formed to be longer as the grid is located relatively below. In other words, they are formed such as a length of the rear plate 151*b* of the first grid 151<a length of the rear plate 152*b* of the second grid 152<a length of the rear plate 153*b* of the third grid 153 . . . . Since a rear plate of the grid located below is formed to be longer than that of the grid located above, arc discharge performance is improved at a rear surface (exhaust port) of the arc extinguishing unit.

In addition, a rear plate of each grid may be formed with a larger inclination angle as the grid is located relatively below. In other words, they are formed such as an inclination angle of the rear plate 151*b* of the first grid 151<an inclination angle of the rear plate 152*b* of the second grid 152<an inclination angle of the rear plate 153*b* of the third grid 153 . . . . Since an inclination angle of the rear plate of the grid located below is formed to be larger than that of the rear plate of the grid located above, arc gas discharged from each rear plate is concentrated toward the exhaust port 160, thereby improving arc discharge performance.

According to an extinguishing device for a molded case circuit breaker in accordance with an embodiment of the present disclosure, the grids are formed with rear plates inclined toward the exhaust port to improve arc gas discharge performance. Accordingly, arc extinguishing performance is improved.

Here, since the rear plates of the grids located below are formed to be longer than those located above, the movement direction of arc gas escaping the grids is easily changed to an upward direction.

Furthermore, since the inclination angle of the rear plates of the grids located below is formed to be larger than that of the rear plates of the grids located above, arc gas is concentrated toward the exhaust port.

As a result, a distance between each grid may be set smaller to provide a larger number of grids in the same space.

According to an arc extinguishing device of a molded case circuit breaker in accordance with another aspect of the present disclosure, a first grid and a second grid having different depths of cutout portions are alternately provided to improve arc extension capability Accordingly, arc extinguishing performance is improved.

The embodiments described above are embodiments implementing the present disclosure, and it will be apparent to those skilled in this art that various changes and modifications may be made thereto without departing from the gist of the present invention. Accordingly, it should be noted that the embodiments disclosed in the present invention are only illustrative and not limitative to the concept of the present invention, and the scope of the concept of the invention is not limited by those embodiments. In other words, the scope protected by the present disclosure should be construed by the accompanying claims, and all the technical concept within the equivalent scope of the invention should be construed to be included in the scope of the right of the present disclosure.

What is claimed is:

1. An arc extinguishing device of a molded case circuit breaker, the device comprising:

a fixed contactor fixedly provided on part of a base assembly case;

a movable contactor brought into contact with or separated from the fixed contactor; and an arc extinguishing unit configured to extinguish an arc generated when the movable contactor is separated from the fixed contactor, and wherein the arc extinguishing unit comprises:

a pair of side plates provided on the base assembly case; and a plurality of grids provided to have a predetermined distance and separated from each other, wherein the plurality of grids are located between the pair of side plates, and wherein the plurality of grids comprise:

a first grid formed with a first cutout portion on a first side surface where the arc is generated; and a second grid formed with a second cutout portion having a depth different from that of the first cutout portion on a second side surface where the arc is generated, wherein the first grid and the second grid are made of steel, wherein each of the grids comprises:

a flat plate provided to have a predetermined first inclination angle with respect to a bottom surface of the base assembly case, and a rear plate extended from a rear surface of the flat plate to have a predetermined second inclination angle, and wherein the second inclination angle is formed to be larger than the first inclination angle, and wherein a cutout surface is formed on both sides of the rear plate.

2. The device of claim 1, wherein a plurality of insertion holes are formed in the pair of side plates, and a plurality of insertion protrusions respectively fastened to the insertion holes are formed on the grids.

3. The device of claim 2, wherein a depth of the first cutout portion or the second cutout portion is formed to be smaller than a position of the insertion protrusion.

4. The device of claim 1, wherein the first grid and the second grid are alternately provided on the pair of side plates.

5. The device of claim 1, wherein a depth difference between the first cutout portion and the second cutout portion is formed smaller than ½ of the depth of the first central portion.

6. The device of claim 1, wherein the first grid or the second grid is formed in a horizontally symmetrical manner.

7. The device of claim 1, wherein a first central portion of the first cutout portion and a second central portion of the second cutout portion are disposed on horizontal center lines of the first grid and the second grid, respectively.

8. The device of claim 1, wherein leg portions are protruded on both sides of a front end portion of the flat plate along a length direction.

9. The device of claim 8, further comprising:

a side cap to which the leg portions are inserted and coupled.

10. The device of claim 1, wherein the plurality of grids are formed such that the rear plate of the grid located below is formed to be longer than that of a grid located above.

11. The device of claim 1, wherein the plurality of grids are formed such that an inclination angle of the rear plate of the grid located below is formed to be larger than that of a grid located above.

12. The device of claim 1, wherein the first inclination angle is less than 15 degrees.

13. The device of claim 1, wherein the second inclination angle is within a range of 15 to 60 degrees.

* * * * *